US006465074B1

(12) United States Patent
FitzPatrick et al.

(10) Patent No.: US 6,465,074 B1
(45) Date of Patent: Oct. 15, 2002

(54) BASE SUBSTRATES FOR COATED BELTS

(75) Inventors: Keith FitzPatrick, Dieren (NL); Francis L. Davenport, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/383,141

(22) Filed: Aug. 25, 1999

(51) Int. Cl.[7] ..... D21F 3/00; B32B 3/24

(52) U.S. Cl. ..... 428/131; 428/156; 428/425.3; 428/423.1; 428/423.3; 442/26; 442/43; 442/66; 442/85; 442/164; 162/358.4; 474/268

(58) Field of Search ..... 428/156, 131, 428/425.3, 423.1, 423.3; 162/358.4; 474/268; 442/26, 43, 66, 85, 164

(56) References Cited

U.S. PATENT DOCUMENTS

| | | | | | |
|---|---|---|---|---|---|
| 3,032,441 | A | * | 5/1962 | Beaumont et al. | 117/138.8 |
| 4,427,734 | A | | 1/1984 | Johnson | 428/234 |
| 4,567,077 | A | | 1/1986 | Gauthier | 428/114 |
| 5,118,391 | A | | 6/1992 | Matuschczyk et al. | 162/358 |
| 5,238,537 | A | | 8/1993 | Dutt | 162/358.4 |
| 5,342,486 | A | * | 8/1994 | Jeffery et al. | 162/358.4 |
| 5,360,656 | A | | 11/1994 | Rexfelt et al. | 428/193 |
| 5,501,133 | A | | 3/1996 | Brookstein et al. | 87/33 |
| 5,772,848 | A | | 6/1998 | Dutt | 162/358.4 |
| 6,027,615 | A | * | 2/2000 | Davenport et al. | 162/358.2 |
| 6,174,825 | B1 | * | 1/2001 | Dutt | 162/358.4 |

FOREIGN PATENT DOCUMENTS

GB 2202873 A * 10/1988

* cited by examiner

*Primary Examiner*—William P. Watkins, III
(74) *Attorney, Agent, or Firm*—Frommer Lawrence & Haug; Ronald R. Santucci

(57) ABSTRACT

A resin-impregnated endless belt for a long nip press or calender of the shoe type, or for other papermaking and paper-processing applications, has a base support structure which includes coated elements, such as yarns, having a coating of a first polymeric resin material. The base support structure is in the form of an endless loop, at least one of the inner and outer surfaces of which is coated with a second polymeric resin material. The second polymeric resin material impregnates the structure of the base support structure, rendering it impermeable to oil and water. The first and second polymeric resin materials have an affinity for one another, so that the coating of second polymeric resin material on the base support structure as a whole establishes a chemical, as well as a mechanical, interlock with the coated yarns having the coating of first polymeric resin material.

76 Claims, 10 Drawing Sheets

12
20
20
10
18
14
18
16

BASE SUBSTRATES FOR COATED BELTS

BACKGROUND OF THE INVENTION

1. Field of the Invention

The present invention relates to mechanisms for extracting water from a web of-material, and more particularly from a cellulosic fibrous web being processed into a paper product on a papermaking machine. Specifically, the present invention is an impermeable belt comprising a polymeric-resin-coated and impregnated base support structure which may include polymeric-resin-coated elements. The belt is designed for use on a long nip press on a papermaking machine. The belt may also be used in other papermaking and paper-processing applications, such as calendering and sheet transfer.

2. Description of the Prior Art

During the papermaking process, a cellulosic fibrous web is formed on a forming fabric by depositing a cellulosic fibrous slurry thereon. A large amount of water is drained from the slurry during this process, after which the newly formed web proceeds to a press section. The press section includes a series of press nips, in which the cellulosic fibrous web is subjected to compressive forces designed to remove water therefrom. The web finally proceeds to a drying section which includes heated dryer drums around which the web is directed. The heated dryer drums reduce the water content of the web to a desirable level through evaporation, thereby completing the manufacture of a paper product from the web.

Rising energy costs have made it increasingly desirable to remove as much water as possible from the cellulosic fibrous web prior to its entering the dryer section. The dryer drums are often heated from within by steam and related costs can be substantial, especially when a large amount of water needs to be removed from the cellulosic fibrous web.

Traditionally, press sections have included a series of nips formed by pairs of adjacent cylindrical press rolls. In recent years, the use of long nip presses has been found to be advantageous over the use of nips formed by pairs of adjacent press rolls. This is because the longer the time a cellulosic fibrous web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip, which can be five to ten times longer in the machine direction than one formed between two press rolls, is formed. This increases the so-called dwell time of the cellulosic fibrous web in the long nip while maintaining an adequate level of pressure per square inch of pressing force. The result of this new long nip technology has been a dramatic increase in dewatering of the cellulosic fibrous web in the long nip when compared to conventional press nips on paper machines.

A long nip press of the shoe type requires a special belt, such as that shown in commonly assigned U.S. Pat. No. 5,238,537 to Dutt. This belt is designed to protect the press fabric supporting, carrying and dewatering the cellulosic fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness at least on the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and cellulosic fibrous web.

The base fabric of the belt shown in U.S. Pat. No. 5,238,537 may be woven from monofilament yarns in a single- or multi-layer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and cellulosic fibrous web.

When the impregnating material is cured to a solid condition, it is primarily bound to the base fabric by a mechanical interlock, wherein the cured impregnating material surrounds the yarns of the base fabric.

While the belts shown in U.S. Pat. No. 5,238,537 have proved to be durable, reliable and long-lived on long nip presses, improvements both in the structure of such belts and in methods for their manufacture are continually being made. Some of the improvements are driven by the need to prevent the polymeric resin coating from delaminating from the base fabric and relate to means for improving the mechanical interlock between the base fabric and the coating. Other improvements relate to the structure of the base fabrics themselves, and are designed to make the base fabrics stronger, more durable, or to the exact dimensional specifications required for a given application. Still other improvements relate to the coating processes, and have as their object the complete impregnation of the base fabric and the provision of a uniformly thick coating of polymeric resin material on the inner surface of its endless configuration without the step of inverting (turning inside out) the belt during the manufacturing process.

The present invention relates, in part, to the need to improve the interlock between the base fabric and the polymeric resin coating of a long nip press belt. More specifically, the present invention is a long nip press belt having a base support structure which may include polymeric-resin-coated yarns, wherein the polymeric resin material used to coat the yarns has an affinity for the polymeric resin material used to coat the belt as a whole, so that the coating on the belt forms a chemical, as well as a mechanical, interlock with the base fabric. In addition to being useful as a long nip press belt, the present invention may also be used in other papermaking and paper-processing applications, such as calendering and sheet transfer.

SUMMARY OF THE INVENTION

Accordingly, the present invention is a resin-impregnated endless belt for a long nip press. The belt may also be used on a calender of the shoe type, as both a long nip press and a calender of that type comprise a cylindrical press roll and an arcuate pressure shoe which together define a nip therebetween. The resin-impregnated endless belt passes through the nip in direct sliding contact with the arcuate pressure shoe, and separates a fibrous web, and perhaps a press fabric or fabrics supporting the fibrous web, from the arcuate pressure shoe, thereby protecting the fibrous web, and the press fabric or fabrics, from damage by direct sliding contact with the arcuate pressure shoe and from contamination by any lubricant on the arcuate pressure shoe. The belt may also be used for other papermaking and paper-processing applications, such as on a roll calender or as a sheet transfer belt.

The resin-impregnated endless belt comprises a base support structure which may include, among the plurality of elements from which it is formed, a plurality of coated elements having a coating of a first polymeric resin material. The base support structure is in the form of an endless loop having an inner surface, an outer surface, a longitudinal direction and a transverse direction.

The base support structure may take one of several forms. In one embodiment, the base support structure may be a woven structure, such as that shown in U.S. Pat. No. 5,238,537, the teachings of which are incorporated herein by reference. Such a woven structure is woven from a plurality of warp yarns and a plurality of weft yarns, wherein the plurality of coated elements having the coating of the first polymeric resin material is included among at least one of the pluralities of warp yarns and weft yarns.

In a second embodiment, the base support structure comprises a structure braided from a plurality of yarns, wherein the plurality of coated elements having the coating of the first polymeric resin material is included among the plurality of yarns. For example, the braided structure may have a plurality of braided yarns, wherein, in each of the layers, at least one yarn thereof extends into a contiguous layer to form an interlock therebetween. The layers are therefore interlocked with one another, and are unable to delaminate from one another. Such a braided structure is shown and described in commonly assigned U.S. Pat. No. 5,501,133 to Brookstein et al., the teachings of which are incorporated herein by reference, and a resin-impregnated endless belt having such a braided structure for a base fabric is shown and described in commonly assigned U.S. Pat. No. 5,772,848 to Dutt, the teachings of which are also incorporated herein by reference.

In a third embodiment, the base support structure comprises a spirally wound fabric strip, wherein the fabric strip has a width smaller than a width of the base support structure. The base support structure has a plurality of non-overlapping, abutting turns of the fabric strip joined along a continuous spiral seam, as shown and described in commonly assigned U.S. Pat. No. 5,360,656 to Rexfelt et al., the teachings of which are incorporated herein by reference. The fabric strip may be woven from a plurality of warp yarns and a plurality of weft yarns, wherein the plurality of coated elements having the coating of the first polymeric resin material is included among at least one of the pluralities of warp yarns and weft yarns. Alternatively, the fabric strip may be a non-woven mesh fabric, such as that shown in U.S. Pat. No. 4,427,734, or a fabric having open spaces between its component yarns, including knitting, lace, net, crochet, braiding and the like. Some portions of the non-woven mesh fabric, or some yarns of the knitted and braided fabrics, are coated with the first polymeric resin material.

In yet other embodiments, the base fabric may comprise a layer of yarns oriented in the longitudinal direction and a layer of yarns oriented in the transverse direction, the yarns in the two layers not being interwoven with one another. A belt having a base fabric of this type is shown and described in U.S. Pat. No. 5,118,391 to Matuschczyk et al., the teachings of which are incorporated herein by reference. The base fabric may also be a spiral-link belt of the variety shown in many U.S. patents, such as U.S. Pat. No. 4,567,077 to Gauthier, the teachings of which are also incorporated herein by reference.

Finally, the base support structure comprises a laminated structure having a plurality of layers, each of the layers being one of the six above-described structures and each including a plurality of coated elements having a coating of a first polymeric resin material having a melting point lower than the material of the yarns themselves. This enables the plurality of layers to be laminated together using heat and pressure. The layers may also be laminated together by driving a fiber batt therethrough by needling or hydroentangling. In such a case, at least some of the fibers in the batt may be of the first polymeric resin material, or may be coated with the first polymeric resin material. Where the base support structure is a laminated structure, one of the layers may be an on-machine-seamable fabric.

In any event, at least one of the inner and outer surfaces of the base support structure has a coating of a second polymeric resin material. The coating impregnates the base support structure and renders it impermeable to liquids, such as oil and water, and is ground and buffed to provide it with a smooth surface, and the belt with a uniform thickness. The second polymeric resin material has an affinity for the first polymeric resin material coating the plurality of coated elements. As a result, the coating of the second polymeric resin material on the base support structure as a whole establishes a chemical, as well as a mechanical, interlock with the plurality of coated elements, having the coating of first polymeric resin material, of the base support structure, and/or with batt fibers, made of or coated with the first polymeric resin, which may be attached to the base support structure.

The present invention will now be described in more complete detail with frequent reference being made to the figures, which are listed and identified below.

DETAILED DESCRIPTION OF THE PREFERRED EMBODIMENTS

Figure 1:
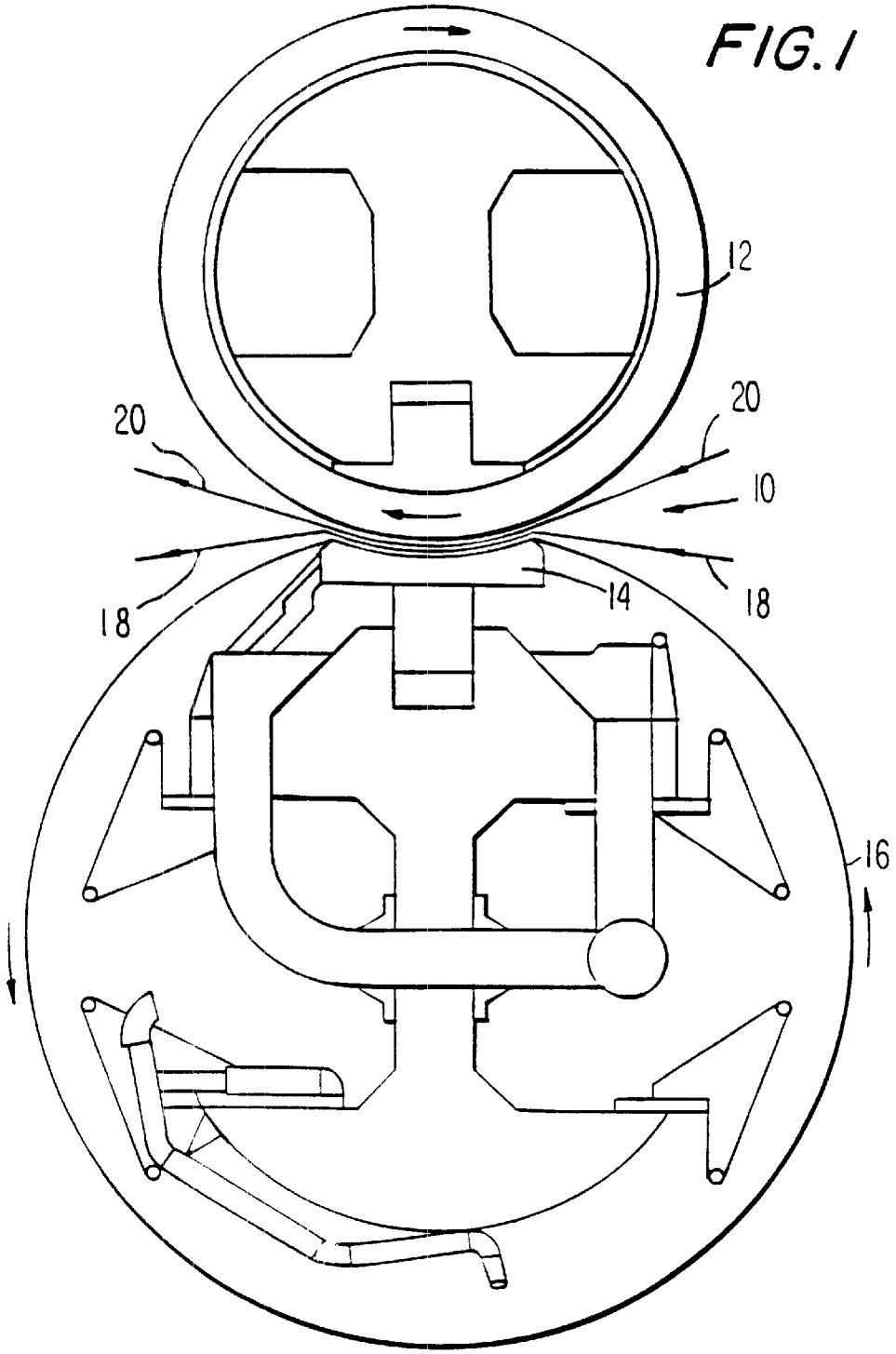
FIG. 1 is a side cross-sectional view of a long nip press.

One type of long nip press for dewatering a cellulosic fibrous web being processed into a paper product on a paper machine is shown in a side cross-sectional view in FIG. 1. The press nip 10 is defined by a smooth cylindrical press roll 12 and an arcuate pressure shoe 14. The arcuate pressure shoe 14 has about the same radius of curvature as the cylindrical press roll 12. The distance between the cylindrical press roll 12 and the arcuate pressure shoe 14 may be adjusted by hydraulic means operatively attached to arcuate pressure shoe 14 to control the loading of the nip 10. Smooth cylindrical press roll 12 may be a controlled crown roll matched to the arcuate pressure shoe 14 to obtain a level cross-machine nip profile.

Long nip press belt 16 extends in a closed loop through nip 10, separating cylindrical press roll 12 from arcuate pressure shoe 14. A press fabric 18 and a cellulosic fibrous web 20 being processed into a paper sheet pass together through nip 10 as indicated by the arrows in FIG. 1. Cellulosic fibrous web 20 is supported by press fabric 18 and comes into direct contact with smooth cylindrical press roll 12 in nip 10. Cellulosic fibrous web 20 and press fabric 18 proceed through the nip 10 as indicated by the arrows. Long nip press belt 16, also moving through press nip 10 as indicated by the arrows, that is, counterclockwise as depicted in FIG. 1, prevents press fabric 18 from directly sliding against arcuate pressure shoe 14, and slides thereover on a lubricating film of oil. Long nip press belt 16, accordingly, must be impermeable to oil, so that press fabric 18 and cellulosic fibrous web 20 will not be contaminated thereby.

The long nip press belt of the present invention is also useful on long nip presses having configurations other than that shown in FIG. 1, such as long nip presses which include a long nip press belt having a long loop travelling in an endless path, entrained around and supported from within by interior support rolls. Further, it should be understood that two press fabrics, one on each side of cellulosic fibrous web 20, may be used on these and other configurations. Finally, the belt of the present invention may also be used as a calender belt for a roll calender or a shoe calender, and as a sheet transfer belt.

Figure 2:
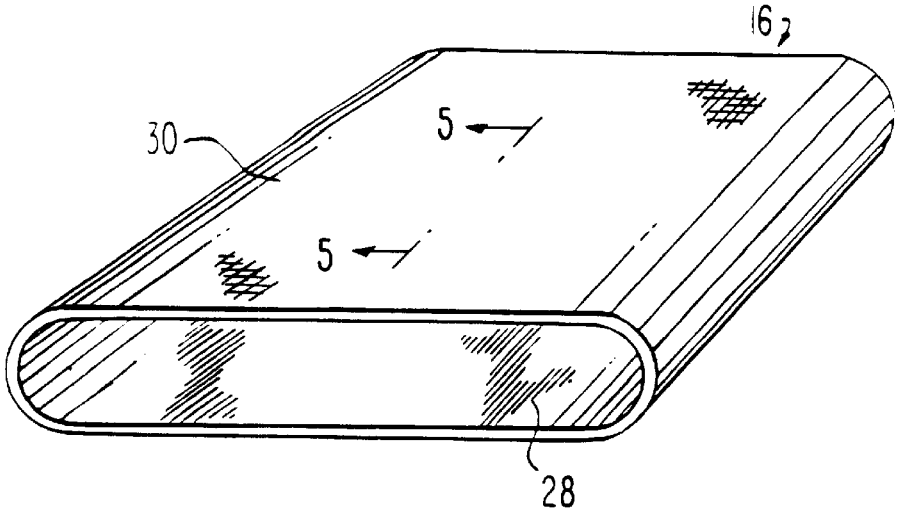
FIG. 2 is a perspective view of a belt of the present invention.

A perspective view of the long nip press belt 16 is provided in FIG. 2. The belt 16 has an inner surface 28 and an outer surface 30. On the outer surface 30, the base support structure of the belt 16 may be visible.

Figure 3:
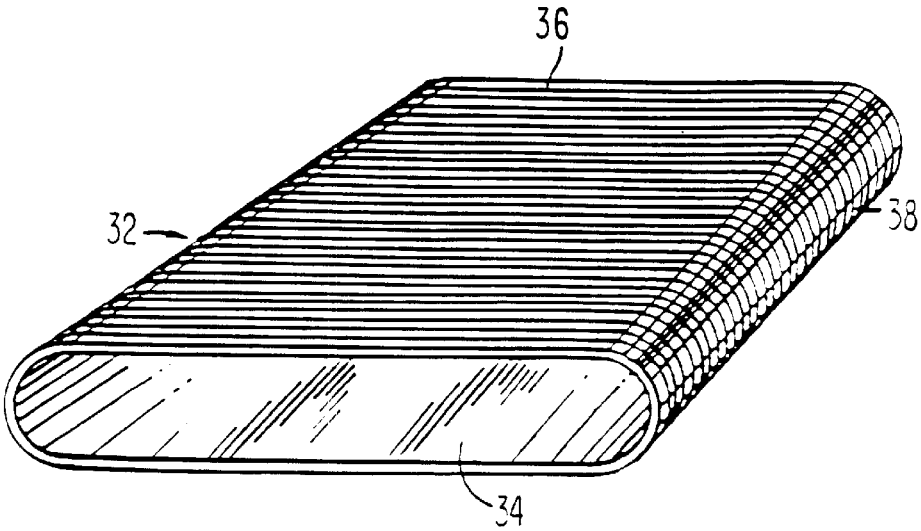
FIG. 3 is a perspective view of an alternate embodiment of the belt.

FIG. 3 is a perspective view of an alternate embodiment of the belt 32. The belt 32 has an inner surface 34 and an outer surface 36. The outer surface 36 is provided with a plurality of grooves 38, for example, in the longitudinal direction around the belt 32 for the temporary storage of water pressed from press fabric 18 and fibrous web 20 in press nip 10.

Figure 4:
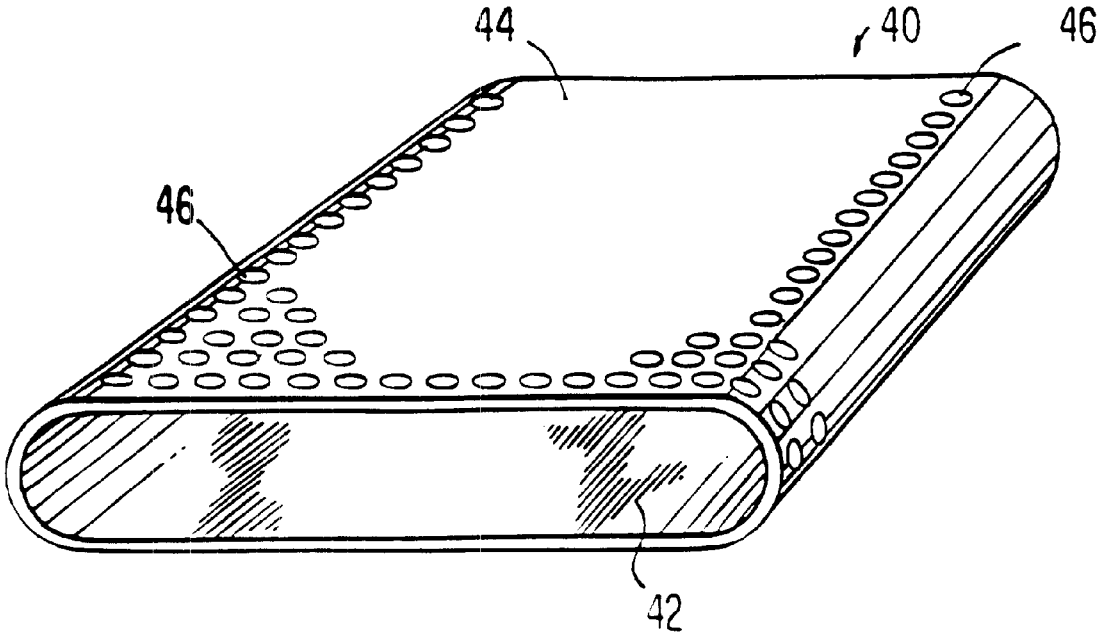
FIG. 4 is a perspective view of another embodiment of the belt.

Alternatively, the outer surface of the belt may be provided with a plurality of blind-drilled holes arranged in some desired geometric pattern for the temporary storage of water. FIG. 4 is a perspective view of such an alternate embodiment of the belt 40. The belt 40 has an inner surface 42 and an outer surface 44. The outer surface 44 is provided with a plurality of blind-drilled holes 46, so called because they do not extend completely through the belt 40.

The long nip press belts 16, 32, 40 shown in FIGS. 2, 3 and 4 include a base support structure formed from a plurality of elements. The base support structure takes the form of an endless loop having an s inner surface, an outer surface, a longitudinal direction and a transverse direction. Among the plurality of elements from which the base support structure is formed is a plurality of coated elements. The coated elements are coated with a first polymeric resin material, which may be, for example, a polyurethane resin material. When the elements are yarns, the yarns may be coated by any of the methods so used by those of ordinary skill in the art, such as dip coating and crosshead extrusion. The coated yarns may also be given their coating after the base support structure has been assembled by weaving, knitting, braiding or the like.

The yarns themselves, coated and uncoated, may be of any of the yarn varieties used by those of ordinary skill in the art to produce paper machine clothing. Monofilament yarns are preferred, although plied monofilament, multifilament, plied multifilament, knitted and braided yarns may also be used. Where a plied, braided or knitted yarn is used, fewer than all of its components may be coated with the first polymeric resin material. For example, in a plied monofilament yarn comprising three pairs of two monofilament ends twisted together, two out of the three pairs may be coated with the first polymeric resin material, and one pair may remain uncoated. The yarns may be of any of the polymeric resins from which yarns for paper machine clothing are commonly extruded or produced, such as polyamide, polyester, polyetheretherketone (PEEK), polyaramid (for example, KEVLAR® and NOMEX®) and polyolefin resins.

Where the yarns are to be coated with a polyurethane resin material, they may be first provided with a coating of a phenolic resin, which will serve as a tie coat, binding the polyurethane coating to the yarns more effectively when the polyurethane is cured. In such a case, preferably, the coating of phenolic resin is partially cured (B-staged) before the polyurethane coating is applied.

Figure 5:
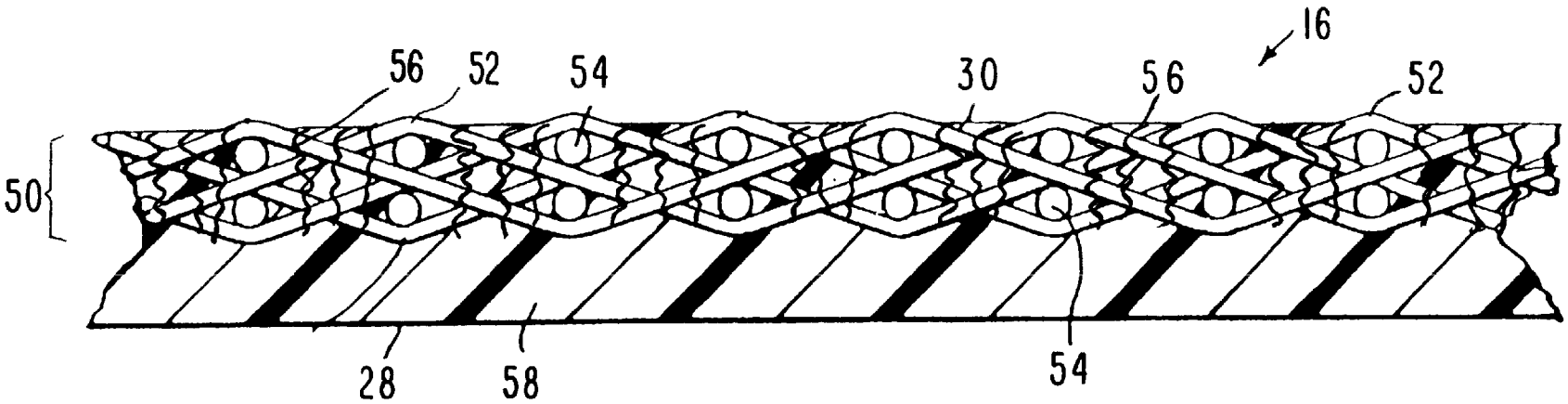
FIG. 5 is a cross-sectional view taken as indicated by line 5—5 in FIG. 2.

In a first embodiment, the base support structure may be a woven structure, such as that shown in U.S. Pat. No. 5,238,537. With the assumption that the belt 16 shown in FIG. 2 has such a base support structure, FIG. 5 is a cross section taken as indicated by line 5—5 in FIG. 2 in the transverse (cross-machine) direction thereof. The base fabric 50 is woven from a plurality of warp yarns 52, seen from the side, and a plurality of weft yarns 54, seen in cross section. The warp yarns 52 lie in the transverse (cross-machine) direction of the belt 16, and the weft yarns 54 lie in the longitudinal (machine) direction thereof, a relationship indicating that the base fabric 50 has been woven endless. It should be understood, however, that the base fabric 50 need not be woven endless to fall within the scope of the present invention. It may, for example, also be flat woven and joined into endless form with a woven seam, in which case the warp yarns will lie in the longitudinal (machine) direction.

As illustrated in FIG. 5, the base fabric 50 is woven in a multi-layer weave. Among the pluralities of warp yarns 52 and weft yarns 54 is a plurality of coated yarns, which may be either warp yarns 52, weft yarns 54 or both. Weaves other than that shown may be used and fall within the scope of the present invention.

The base fabric 50 may also include a staple fiber batt 56 needled or otherwise entangled into the woven structure thereof. The staple fiber batt 56 may comprise fibers of a polymeric resin material, such as polyamide or polyester, or of any of the other materials commonly used for this purpose by those in the paper machine clothing industry. The fibers may, in addition, be coated with the same first polymeric resin material coating the yarns, or may themselves be made of the first polymeric resin material, to improve the bond to be formed with the impregnating material. Where a polyurethane resin material is to be the coating, the fibers may first be coated with a phenolic resin, which will act as a tie coat upon curing. Again, it is preferable to cure the phenolic resin partially (B-stage) before the polyurehane resin material is applied.

At least the inner surface of the base fabric 50 has a coating of a second polymeric resin material 58, which impregnates the base fabric 50 and renders the belt 16 impervious to oil and water. After curing, the second polymeric resin material 58 is ground and buffed to provide the belt 16 with a smooth surface and a uniform thickness.

The second polymeric resin material 58 coating the base fabric 50 has an affinity for the first polymeric resin material coating the plurality of coated yarns, or staple fiber batt 56, if present. In practice, the existence of such an affinity is what governs the choice of the materials used as the first and second polymeric resin materials. Both may be polyurethane resin materials although other polymeric resin materials having the necessary affinities may be used to coat the yarns and to coat the base fabric 50 as a whole. In any event, the affinity permits the establishment of a chemical interlock between the second polymeric resin material and the first polymeric resin material coating at least some of the yarns, and possibly staple fiber batt 56, to supplement the mechanical interlock that forms between the cured second polymeric resin material and the yarns of the base fabric.

In general, the base support structure must be of an openness sufficient to ensure its almost complete impregnation by the second polymeric resin material, an unimpregnated portion, formed by a small portion of the warp and/or weft yarn knuckles which may be exposed above the coating on the uncoated side of the base fabric 50, often remaining on that side. Such almost complete impregnation eliminates the possibility of undesirable voids forming within the finished belt. Voids are particularly undesirable because they may allow the lubricating oil used between the belt and the arcuate pressure shoe to pass through the belt and contaminate the press fabric 18, or press fabrics, and cellulosic fibrous web 20 being processed into paper. Further, penetration of oil into the coating could cause the coating to delaminate from the base fabric.

In a second embodiment, the base support structure comprises a braided structure, which is braided from a plurality of yarns, among which is a plurality of yarns coated with the first polymeric resin material. For example, such a braided structure may be manufactured according to the teachings of commonly assigned U.S. Pat. No. 5,501,133, which shows a multilayer braided structure in which the layers are interbraided. The interbraiding of the layers provides an interlock therebetween which prevents the delamination of multiple braided layers from one another.

The interlock between the layers may be a direct interlock in which the interlocking yarn passes from a first layer to a contiguous second layer, and passes around at least one yarn in the second layer.

Alternatively, the interlock between the layers may be an indirect interlock in which an interlocking yarn passes from the first layer through the second layer to another, not necessarily contiguous, layer in the structure, and passes around a strand in the other layer to serve to bind the first layer and the other layer together and at the same time to bind the layers therebetween.

To manufacture a base fabric for a long nip press belt, the braided structure may be of a hollow, tubular form. In view of the fact that long nip press belts, depending on the size requirements of the long nip presses on which they are installed, have lengths from roughly 10 to 40 feet (approximately 3 to 12 meters), measured longitudinally around their endless-loop forms, and widths from roughly 100 to 450 inches (approximately 250 to 1125 centimeters), measured transversely across those forms, the production of the base fabric may require a cylindrical braiding mandrel having a diameter from roughly 3 to 12 feet (approximately 1 to 4 meters) and a length from roughly 100 to 450 inches (approximately 250 to 1125 centimeters).

A braided base fabric for a long nip press belt is shown in U.S. Pat. No. 5,772,848. As above, the base fabric must be of an openness sufficient to ensure its almost complete impregnation by the second polymeric resin material. It may also be needled with a staple fiber batt of the same varieties as were described above.

Figure 6:
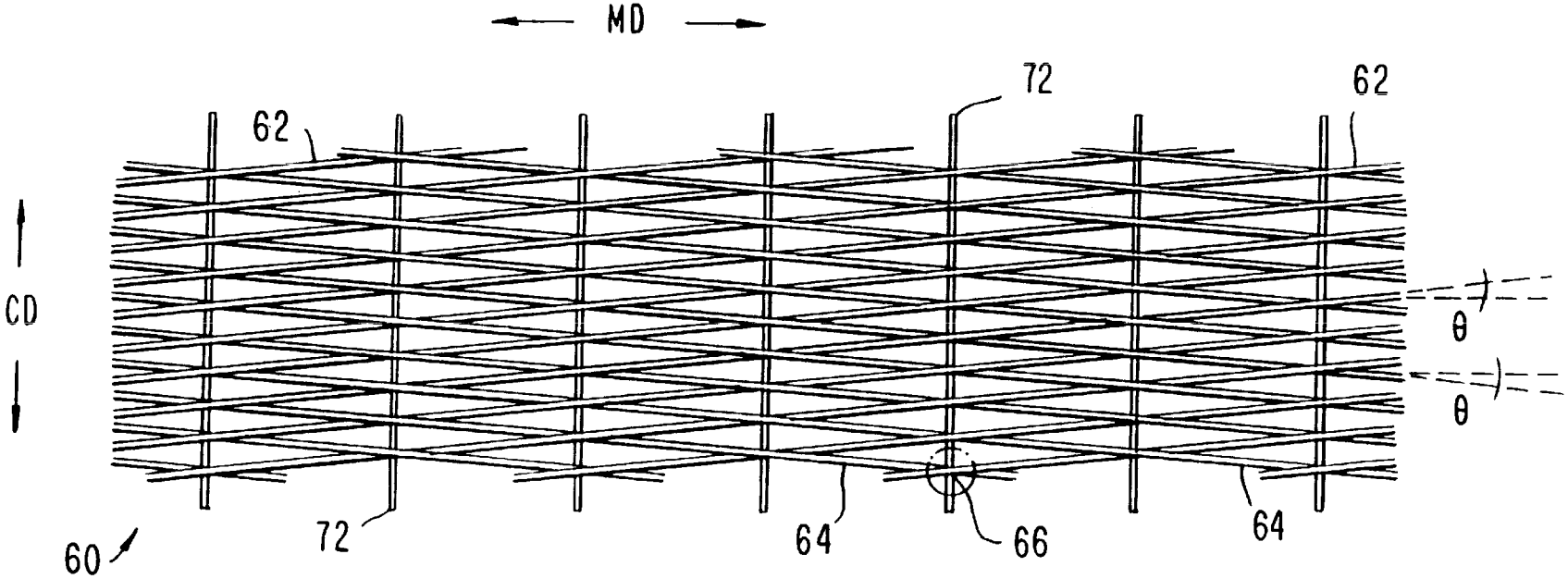
FIG. 6 is a plan view of a portion of the outer surface of a braided base fabric for the present belt.

FIG. 6 is a plan view of a portion of the outer surface of such a braided base fabric 60. The machine (longitudinal) and cross-machine (transverse) directions are as indicated in the figure. Yarns 62,64 make an angle $\Theta$ of 5° or less with respect to the machine direction of the long nip press belt, and therefore, at their crossing points 66, make an angle of 10° or less with respect to each other.

Figure 7:
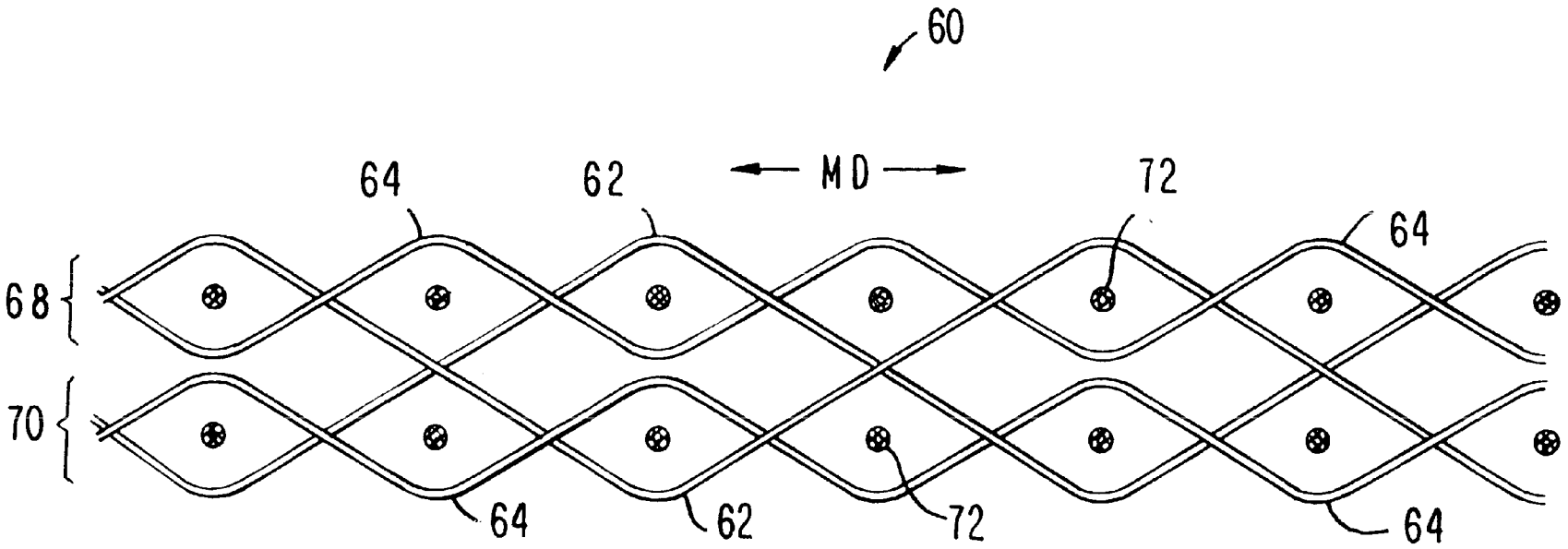
FIG. 7 is a schematic cross-sectional view of the braided base fabric taken in the longitudinal, or machine, direction thereof.

FIG. 7 is a schematic cross-sectional view of the braided base fabric 60 taken in the longitudinal, or machine, direction (MD) thereof. Fabric 60 comprises a first braided layer 68 and a second braided layer 70 defined by yarns 64 which define left-handed spirals about the base fabric 60. Yarns 62, which define right-handed spirals about the base fabric 60, pass back and forth between the two braided layers 68,70 to interlock them together. Reinforcing yarns 72 are directed transversely across the base fabric 60 within its braided structure. The reinforcing yarns 72 are particularly important where the press belt is of the "press jacket" variety held by clamping rings on the widthwise edges of the press.

In a third embodiment, the base support structure comprises a spirally wound woven fabric strip, wherein the woven fabric strip has a width smaller than a width of the base fabric as a whole. The base support structure has a plurality of non-overlapping, abutting turns of the woven fabric strip joined along a continuous seam, and may be manufactured in accordance with the teachings of commonly assigned U.S. Pat. No. 5,360,656. The fabric strip is woven from a plurality of warp yarns and a plurality of weft yarns. Among the pluralities of warp yarns and weft yarns is a plurality of coated yarns having a coating of the first polymeric resin material.

Figure 8:
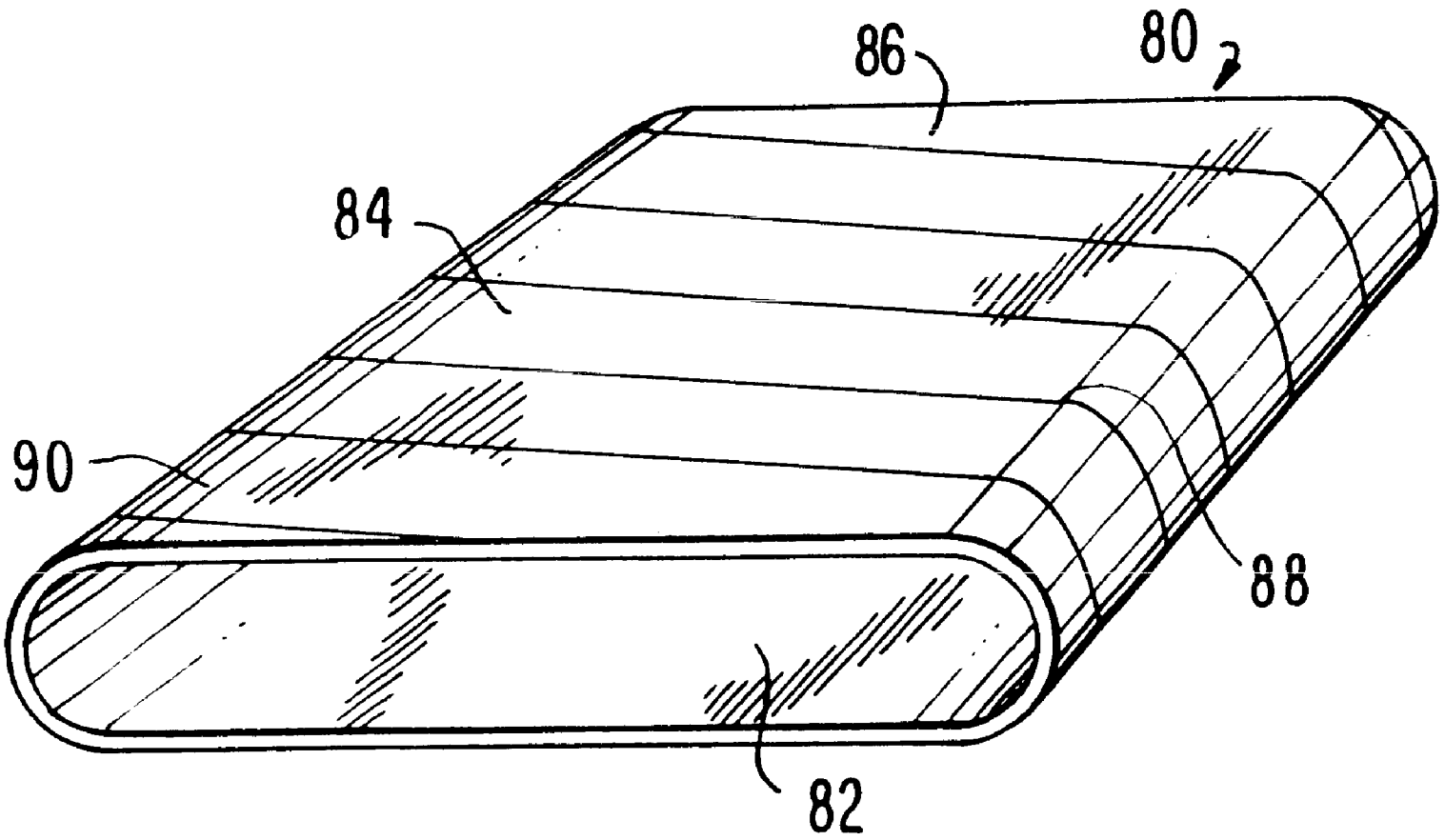
FIG. 8 is a perspective view of still another embodiment of the belt.

FIG. 8 is a perspective view of a belt 80 belonging to this embodiment. Belt 80 has an inner surface 82 and an outer surface 84. On the outer surface 84, the base fabric 86 and its spirally continuous seam 88 may be seen. Clearly, the woven fabric strip 80, because it is spirally wound in the production of base fabric 86, and the continuous seam 88 are oriented at a small angle to the longitudinal (machine) direction. A cross section, taken as indicated in FIG. 8 in a direction parallel to the spirally continuous seam 88, has an appearance identical to that already seen and discussed in FIG. 5, although in this case, the warp yarns 52 are oriented at a slight angle to the longitudinal (machine) direction of the belt 80. In all other respects, the discussion of FIG. 5 given above is equally applicable here.

Figure 9:
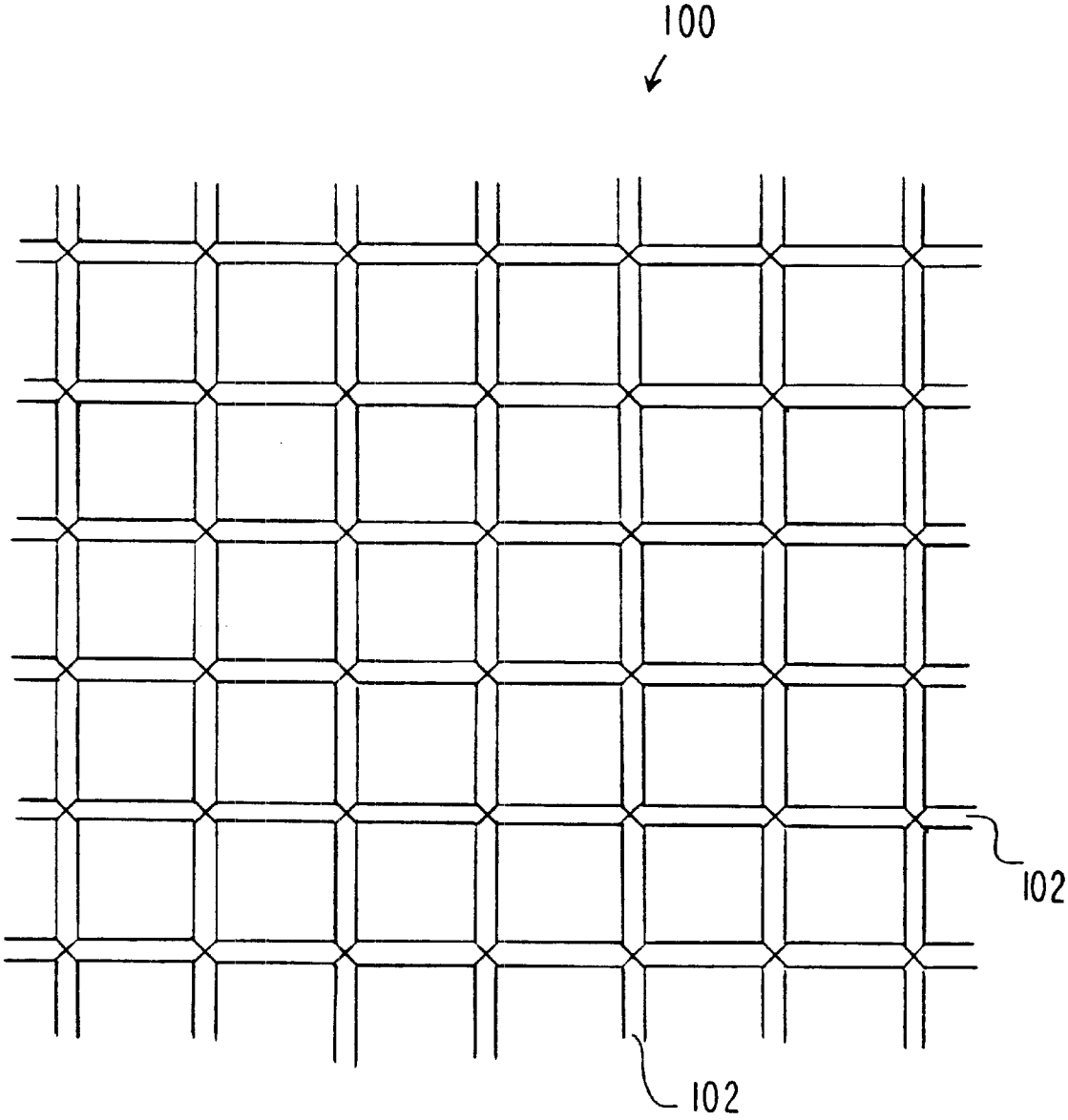
FIG. 9 is a plan view of a non-woven mesh fabric.

Instead of spirally winding a woven fabric strip 90 to assemble base fabric 86, a non-woven mesh fabric, such as that shown in commonly assigned U.S. Pat. No. 4,427,734 to Johnson, the teachings of which are incorporated herein by reference, may be used in like manner to assemble a base fabric. A plan view of such a non-woven mesh fabric 100 is presented in FIG. 9. Non-woven mesh fabric 100 comprises a plurality of crisscrossing members 102.

Figure 10:
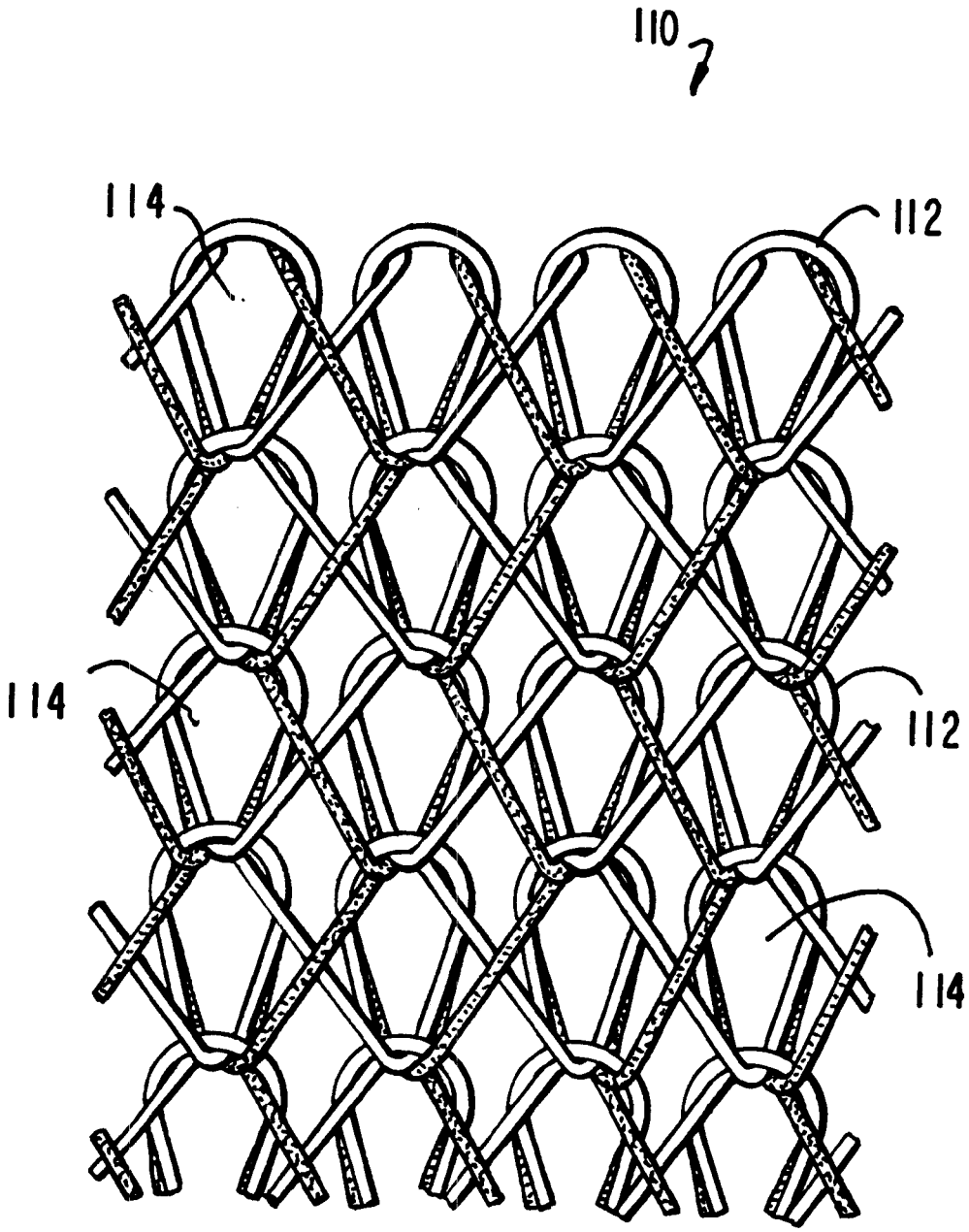
FIG. 10 is a plan view of a knitted fabric.

Alternatively, a strip of knitted or braided fabric may be spirally wound in this manner to assemble a base fabric. A plan view of a knitted fabric 110 is presented in FIG. 10. The knitted fabric 110 comprises a network of interlaced loops 112 forming stitches 114. A plan view of the braided fabric would have the same appearance as that presented earlier in FIG. 6.

In these variations of this third embodiment, the non-woven mesh fabric 100, and at least some of the yarns in the knitted fabric 110 and braided fabric, are coated with the first polymeric resin material. Moreover, all of the base fabrics characterizing this third embodiment may be needled with a staple fiber batt of the same varieties as were described above.

Finally, the base support structure may comprise a laminated structure having a plurality of layers. Each of the layers may be of one of the four above-described structures, each of which includes a plurality of coated yarns coated with a first polymeric resin material. In addition to enabling a chemical interlock to be formed between the second polymeric resin material coating and impregnating the base fabric as a whole, the coating of first polymeric resin material on the plurality of coated yarns in each of the layers enables the layers to be joined to one another using heat and pressure.

In general, the layers may all be of the same type of structure; that is to say, they may be all woven structures, all knitted structures, and so forth. Alternatively, different types of the above-described structures may be laminated together in any desired order to form a base support structure. In case a plurality of spirally wound fabric strip structures are to be laminated together, adjacent layers may be spiralled in opposite directions relative to one another. Further, one layer may be a fabric structure that is seamable on a paper machine, and the other layer or layers may be of any of the structures described above, such as spirally wound fabric strip structures.

To facilitate the lamination of the plurality of layers, a web or film of first polymeric resin material may be provided as an intermediate layer between each pair of layers in the laminated structure of the base fabric. Alternatively, the web or film of first polymeric resin may be on the inside or outside of an otherwise non-laminated base fabric. Such a film or web must be porous, perhaps as a consequence of being needled or of being perforated during manufacture, to enable the second polymeric resin to pass therethrough to impregnate the base fabric. The film or web may be spirally wound onto the surface of a base fabric or a layer thereof in accordance with the teachings of U.S. Pat. No. 5,360,656. The film may be of polyurethane and have a thickness of 0.50 mm and a weight of 350 grams per square meter. Subsequently, the film or web of first polymeric resin chemically bonds with the second polymeric resin of the coating.

Figure 11:
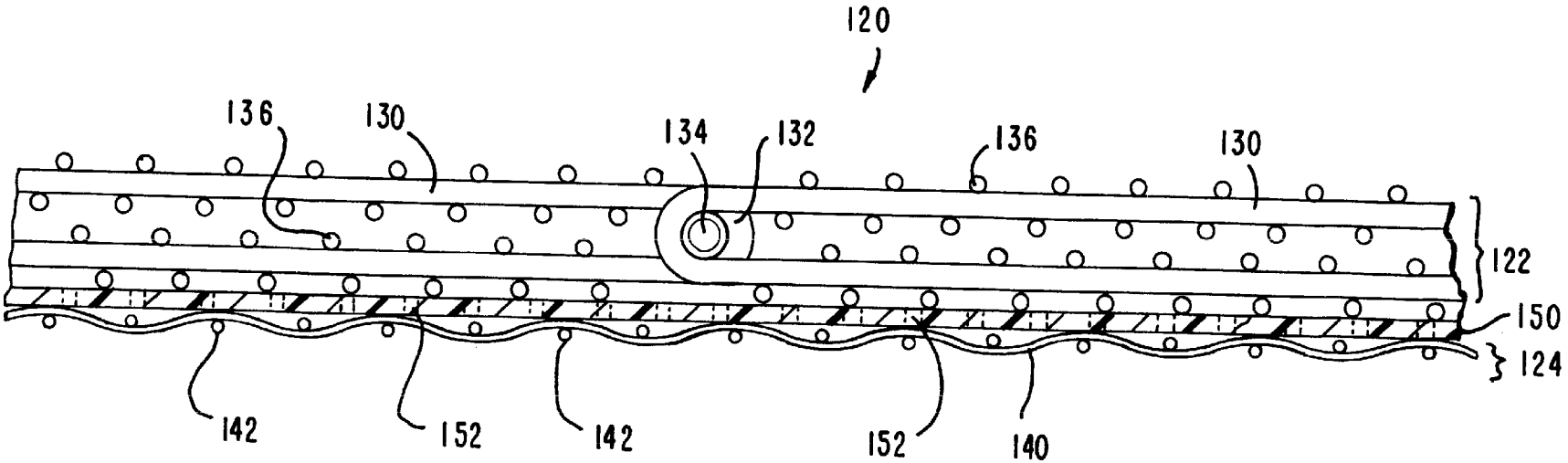
FIG. 11 is a cross-sectional view, taken in the machine direction of a base support structure having a laminated structure.

For the purposes of illustration, FIG. 11 is a cross-sectional view, taken in the machine direction, of a base fabric 120 having such a laminated structure. Base fabric 120 comprises a first layer 122 and a second layer 124.

The first layer 122 is woven in a two-layer, or duplex, weave. Machine-direction yarns 130, which are the weft yarns in the one-machine-seamable fabric used as the first layer 122, form seaming loops 132 which are interdigitated to create a passage through which a pintle 134 is directed to join the first layer 122 into endless form. Cross-machine direction yarns 136 are the warp yarns during the weaving of the first layer 122.

The first layer 122 need not be an on-machine-seamable fabric, although this is preferred because it would permit the belt to be joined into endless form during installation on a paper machine.

The second layer 124 is attached to the inside of the first layer 122. That is to say, more specifically, second layer 124 is attached to the inner surface of the endless loop formed by the first layer 122.

The second layer 124 is of a single-layer weave, such as a plain weave, and may be joined into endless form with a woven seam, or may be woven endless. The second layer 124 is woven from machine-direction yarns 140 and cross-machine-direction yarns 142.

The first layer 122 and the second layer 124 may be separated by a film 150 of first polymeric resin material. The film 150 has perforations 152, and facilitates the lamination of the first layer 122 and the second layer 124 by adhering to the yarns coated with the first polymeric resin material in the two layers 122,124 in response to heat and pressure to hold the two layers 122,124 together.

It should be understood that, where the base support structure comprises a laminated structure having a plurality of layers, each of the layers takes the form of an endless loop. The laminated structure, then, comprises a plurality of nested endless loops.

In general, both surfaces of the base support structure may be coated with the second polymeric resin material. Following the curing of the second polymeric resin material, both the inner surface and the outer surface of the belt thereby obtained may be ground and buffed to provide the belt with smooth surfaces and a uniform thickness. Finally, the outer surface may be provided, by cutting, scoring, graving or drilling, with a plurality of grooves, for example, in the longitudinal direction around the belt, or blind holes for the temporary storage of water pressed from fibrous web 20 in the press nip 10.

It will be recognized that modifications to the above would be obvious to anyone of ordinary skill in the art without departing from the scope of the claims appended hereinbelow. For example, all of the base support structures heretofore described include yarns or a non-woven mesh fabric coated with the first polymeric resin material. It is clear that the improved interlock between base support structure and polymeric resin coating sought by means of the present invention may also be achieved by attaching a staple fiber batt having fibers coated with, or entirely composed of, the first polymeric resin material to a base fabric having uncoated yarns. This modification is considered to fall within the scope of the present invention and is claimed hereinbelow.

What is claimed is:

1. A resin-impregnated endless belt for a long nip press or calendar of the shoe type, or for other papermaking and paper-processing applications, said resin-impregnated endless belt comprising: a base support structure, said base support structure including a plurality of coated elements having a coating of a first polymeric resin material of phenol or polyurethane, said base support structure being in the form of an endless loop with an inner surface, an outer surface, a longitudinal direction and a transverse direction; and a coating of a second polymeric resin material comprising polyurethane on at least one of said inner and outer surfaces of said base support structure, said coating impregnating and rendering said base support structure impermeable to liquids, said coating being smooth and providing said belt with a uniform thickness, said second polymeric resin material having an affinity for said first polymeric resin material coating said plurality of coated elements, so that said coating of said second polymeric resin material establishes a chemical, as well as a mechanical, interlock with said plurality of coated elements of said base support structure.

2. A belt as claimed in claim 1 wherein said coating of said second polymeric resin material is on both of said inner and outer surfaces of said base support structure, and wherein said coating on both of said inner and outer surfaces is smooth and provides said belt with a uniform thickness.

3. A belt as claimed in claim 1 wherein said coating on said inner surface of said base support structure is ground and buffed to give said belt a uniform thickness and desired surface characteristics.

4. A belt as claimed in claim 2 wherein said coating on both of said inner and outer surfaces is ground and buffed to give said belt a uniform thickness and desired surface characteristics.

5. A belt as claimed in claim 2 wherein said coating on said outer surface of said belt includes a plurality of grooves.

6. A belt as claimed in claim 2 wherein said coating on said outer surface of said belt includes a plurality of blind-drilled holes.

7. A belt as claimed in claim 1 wherein said base support structure comprises a structure woven from a plurality of warp yarns and a plurality of weft yarns, wherein said plurality of coated elements having said coating of said first polymeric resin material is included among at least one of said plurality of warp yarns and said plurality of weft yarns.

8. A belt as claim in claim 7 wherein individual yarns of said plurality of warp yarns and said plurality of weft yarns are of a polymeric resin material selected from the group consisting of polyamide, polyester, polyetheretherketone (PEEK), polyaramid and polyolefin resins.

9. A belt as claimed in claim 7 wherein individual yarns of said plurality of warp yarns and said plurality of weft yarns are of one of the yarn varieties selected from the group consisting of monofilament, plied monofilament, multifilament, plied multifilament, knitted and braided yarns.

10. A belt as claimed in claim 1 wherein said base support structure comprises a structure braided from a plurality of yarns, wherein said plurality of coated elements having said coating of said first polymeric resin material is included among said plurality of yarns.

11. A belt as claimed in claim 10 wherein said braided structure has a plurality of braided layers of yarns, wherein in each of said layers at least one yarn thereof extends into a contiguous layer to form an interlock therebetween.

12. A belt as claimed in claim 10 wherein individual yarns of said plurality of yarns are of a polymeric resin material selected from the group consisting of polyamide, polyester, polyetheretherketone (PEEK), polyaramid and polyolefin resins.

13. A belt as claimed in claim 10 wherein individual yarns of said plurality of yarns are of one of the yarn varieties selected from the group consisting of monofilament, plied monofilament, multifilament, plied multifilament, knitted and braided yarns.

14. A belt as claimed in 11 claim further comprising a plurality of reinforcing yarns, said reinforcing yarns extending in said transverse direction of said base support structure between at least one pair of said layers of yarns.

15. A belt as claimed in claim 14 wherein at least some of said plurality of reinforcing yarns are coated with said first polymeric resin material.

16. A belt as claimed in claim 14 wherein individual yarns of said plurality of reinforcing yarns are of a polymeric resin material selected from the group consisting of polyamide, polyester, polyetheretherketone (PEEK), polyaramid and polyolefin resins.

17. A belt as claimed in claim 14 wherein individual yarns of said plurality of reinforcing yarns are of one of the yarn varieties selected from the group consisting of monofilament, plied monofilament, multifilament, plied multifilament, knitted and braided yarns.

18. A belt as claimed in claim 1 wherein said base support structure comprises a spirally wound fabric strip, said fabric strip having a width smaller than a width of said base support structure, said base support structure having a plurality of non-overlapping, abutting turns of said fabric strip joined along a continuous seam, said fabric strip being selected from the group consisting of woven fabrics, non-woven mesh fabrics, knitted fabrics and braided fabrics.

19. A belt as claimed in claim 18 wherein said fabric strip is a woven fabric, wherein said woven fabric comprises a structure woven from a plurality of warp yarns and a plurality of weft yarns, wherein said plurality of coated elements having said coating of said first polymeric resin material is included among at least one of said plurality of warp yarns and said plurality of weft yarns.

20. A belt as claimed in claim 19 wherein individual yarns of said plurality of warp yarns and said plurality of weft yarns are of a polymeric resin material selected from the group consisting of polyamide, polyester, polyetheretherketone (PEEK), polyaramid and polyolefin resins.

21. A belt as claimed in claim 19 wherein individual yarns of said plurality of warp yarns and said plurality of weft yarns are of one of the yarn varieties selected from the group consisting of monofilament, plied monofilament, multifilament, plied multifilament, knitted and braided yarns.

22. A belt as claimed in claim 18 wherein said fabric strip is a non-woven mesh fabric, wherein said non-woven mesh fabric comprises a structure formed by a plurality of crisscrossing members, wherein said plurality of coated elements having said coating of said first polymeric resin material is included among said plurality of crisscrossing members.

23. A belt as claimed in claim 22 wherein said plurality of crisscrossing members are of a polymeric resin material selected from the group consisting of polyamide, polyester, polyetheretherketone (PEEK), polyaramid and polyolefin resins.

24. A belt as claimed in claim 18 wherein said fabric strip is a knitted fabric, wherein said knitted fabric comprises a structure knitted from a plurality of yarns, wherein said plurality of coated elements having said coating of said first polymeric resin material is included among said plurality of yarns.

25. A belt as claimed in claim 24 wherein individual yarns of said plurality of yarns are of a polymeric resin material selected from the group consisting of polyamide, polyester, polyetheretherketone (PEEK), polyaramid and polyolefin resins.

26. A belt as claimed in claim 24 wherein individual yarn of said plurality of yarns are of one of the yarn varieties selected from the group consisting of monofilament, plied monofilament, multifilament, plied multifilament, knitted and braided yarns.

27. A belt as claimed in claim 18 wherein said fabric strip is a braided fabric, wherein said braided fabric comprises a structure braided from a plurality of yarns, wherein said plurality of coated elements having said coating of said first polymeric resin material is included among said plurality of yarns.

28. A belt as claimed in claim 27 wherein individual yarns of said plurality of yarns are of a polymeric resin material selected from the group consisting of polyamide, polyester, polyetheretherketone (PEEK), polyaramid and polyolefin resins.

29. A belt as claimed in claim 27 wherein individual yarns of said plurality of yarns are of one of the yarn varieties selected from the group consisting of monofilament, plied monofilament, multifilament, plied multifilament, knitted and braided yarns.

30. A belt as claimed in claim 1 wherein said base support structure comprises a laminated structure having a plurality of layers, each of said layers being selected from the group consisting of a woven structure, a braided structure, a spirally wound fabric strip structure, a structure of non-interwoven longitudinal-direction yarns and transverse-direction yarns, and a spiral-link fabric structure and wherein each of said layers including a plurality of coated elements having a coating of a first polymeric resin material, whereby said plurality of layers are laminated together using heat and pressure.

31. A belt as claimed in claim 30 further comprising an intermediate layer between two of said plurality of layers, said intermediate layer being a web of said first polymeric resin material.

32. A belt as claimed in claim 30 further comprising an intermediate layer between two of said plurality of layers, said intermediate layer being a film of said first polymeric resin material.

33. A belt as claimed in claim 30 wherein one of said plurality of layers is an on-machine-seamable fabric.

34. A belt as claimed in claim 1 further comprising a batt of staple fibers attached to said base support structure and encapsulated within said coating of said second polymeric resin material.

35. A belt as claimed in claim 34 wherein at least some of said fibers in said batt of staple fibers are coated with said first polymeric resin material.

36. A belt as claimed in claim 34 wherein at least some of said fibers of said batt of staple fibers are of said first polymeric resin material.

37. A belt as claimed in claim 1 wherein said base support structure comprises a layer of yarns oriented in the longitudinal direction and a layer of yarns oriented in the transverse direction, said yarns in said two layers not being interwoven with one another, wherein said plurality of coated elements having said coating of said first polymeric resin material is included among said yarns in at least one of said two layers.

38. A belt as claimed in claim 1 wherein said base support structure comprises a spiral-link fabric, wherein said plurality of coated elements having said coating of said first polymeric resin material is included among spiral links making up said fabric.

39. A resin-impregnated endless belt for a long nip press or calender of the shoe type, or for other papermaking and paper-processing applications, said resin-impregnated endless belt comprising:

a base support structure, said base support structure being in the form of an endless loop with an inner surface, an outer surface, a longitudinal direction and a transverse direction;

a batt of staple fibers attached to said base support structure, at least some of said fibers of said batt of staple fibers including a first polymeric resin material; and a coating of a second polymeric resin material on at least one of said inner and outer surfaces of said base support structure, said coating impregnating and rendering said base support structure impermeable to liquids and encapsulating said batt of stable fibers, said coating being smooth and providing said belt with a uniform thickness, said second polymeric resin material having an affinity for said first polymeric resin material included in said batt of staple fibers, so that said coating of said second polymeric resin material establishes a chemical, as well as a mechanical, interlock with said batt of stable fibers attached to said base support structure.

40. A belt as claimed in claim 39 wherein said coating of said second polymeric resin material is on both of said inner and outer surfaces of said base support structure, and wherein said coating on both of said inner and outer surfaces is smooth and provides said belt with a uniform thickness.

41. A belt as claimed in claim 39 wherein said coating on said inner surface of said base support structure is ground and buffed to give said belt a uniform thickness and desired surface characteristics.

42. A belt as claimed in claim 40 wherein said coating on both of said inner and outer surfaces is ground and buffed to give said belt a uniform thickness and desired surface characteristics.

43. A belt as claimed in claim 40 wherein said coating on said outer surface of said belt includes a plurality of grooves.

44. A belt as claimed in claim 40 wherein said coating on said outer surface of said belt includes a plurality of blind-drilled holes.

45. A belt as claimed in claim 39 wherein said first and second polymeric resin materials are polyurethane resin materials.

46. A belt as claimed in claim 39 wherein said base support structure comprises a structure woven from a plurality of warp yarns and a plurality of weft yarns.

47. A belt as claim in claim 46 wherein individual yarns of said plurality of warp yarns and said plurality of weft yarns are of a polymeric resin material selected from the group consisting of polyamide, polyester, polyetheretherketone (PEEK), polyaramid and polyolefin resins.

48. A belt as claimed in claim 46 wherein individual yarns of said plurality of warp yarns and said plurality of weft yarns are of one of the yarn varieties selected from the group consisting of monofilament, plied monofilament, multifilament, plied multifilament, knitted and braided yarns.

49. A belt as claimed in claim 39 wherein said base support structure comprises a structure braided from a plurality of yarns.

50. A belt as claimed in claim 49 wherein said braided structure has a plurality of braided layers of yarns, wherein in each of said layers at least one yarn thereof extends into a contiguous layer to form an interlock therebetween.

51. A belt as claimed in claim 49 wherein individual yarns of said plurality of yarns are of a polymeric resin material selected from the group consisting of polyamide, polyester, polyetheretherketone (PEEK), polyaramid and polyolefin resins.

52. A belt as claimed in claim 49 wherein individual yarns of said plurality of yarns are of one of the yarn varieties selected from the group consisting of monofilament, plied monofilament, multifilament, plied multifilament, knitted and braided yarns.

53. A belt as claimed in claim 50 further comprising a plurality of reinforcing yarns, said reinforcing yarns extending in said transverse direction of said base support structure between at least one pair of said layers of yarns.

54. A belt as claimed in claim 53 wherein individual yarns of said plurality of reinforcing yarns are of a polymeric resin material selected from the group consisting of polyamide, polyester, polyetheretherketone (PEEK), polyaramid and polyolefin resins.

55. A belt as claimed in claim 53 wherein individual yarns of said plurality of reinforcing yarns are of one of the yarn varieties selected from the group consisting of monofilament, plied monofilament, multifilament, plied multifilament, knitted and braided yarns.

56. A belt as claimed in claim 39 wherein said base support structure comprises a spirally wound fabric strip, said fabric strip having a width smaller than a width of said base support structure, said base support structure having a plurality of non-overlapping, abutting turns of said fabric strip joined along a continuous seam, said fabric strip being selected from the group consisting of woven fabrics, non-woven mesh fabrics, knitted fabrics and braided fabrics.

57. A belt as claimed in claim 56 wherein said fabric strip is a woven fabric, wherein said woven fabric comprises a structure woven from a plurality of warp yarns and a plurality of weft yarns.

58. A belt as claimed in claim 57 wherein individual yarns of said plurality of warp yarns and said plurality of weft yarns are of a polymeric resin material selected from the group consisting of polyamide, polyester, polyetheretherketone (PEEK), polyaramid and polyolefin resins.

59. A belt as claimed in claim 57 wherein individual yarns of said plurality of warp yarns and said plurality of weft yarns are of one of the yarn varieties selected from the group consisting of monofilament, plied monofilament, multifilament, plied multifilament, knitted and braided yarns.

60. A belt as claimed in claim 56 wherein said fabric strip is a non-woven fabric, wherein said non-woven mesh fabric comprises a structure formed by a plurality of crisscrossing members.

61. A belt as claimed in claim 60 wherein said plurality of crisscrossing members are of a polymeric resin material selected from the group consisting of polyamide, polyester, polyetheretherketone (PEEK), polyaramid and polyolefin resins.

62. A belt as claimed in claim 56 wherein said fabric strip is a knitted fabric, wherein said knitted fabric comprises a structure knitted from a plurality of yarns.

63. A belt as claimed in claim 62 wherein individual yarns of said plurality of yarns are of a polymeric resin material selected from the group consisting of polyamide, polyester, polyetheretherketone (PEEK), polyaramid and polyolefin resins.

64. A belt as claimed in claim 62 wherein individual yarns of said plurality of yarns are of one of the yarn varieties selected from the group consisting of monofilament, plied monofilament, multifilament, plied multifilament, knitted and braided yarns.

65. A belt as claimed in claim 56 wherein said fabric strip is a braided fabric, wherein said braided fabric comprises a structure braided from a plurality of yarns.

66. A belt as claimed in claim 65 wherein individual yarns of said plurality of yarns are of a polymeric resin material selected from the group consisting of polyamide, polyester, polyetheretherketone (PEEK), polyaramid and polyolefin resins.

67. A belt as claimed in claim 65 wherein individual yarns of said plurality of yarns are of one of the yarn varieties selected from the group consisting of monofilament, plied monofilament, multifilament, plied multifilament, knitted and braided yarns.

68. A belt as claimed in claim 39 wherein said base support structure comprises a laminated structure having a plurality of layers, each of said layers being selected from the group consisting of a woven structure, a braided structure, a spirally wound fabric strip structure, a structure of non-interwoven longitudinal-direction yarns and transverse-direction yarns, and a spiral-link fabric structure.

69. A belt as claimed in claim 68 further comprising an intermediate layer between two of said plurality of layers, said intermediate layer being a web of said first polymeric resin material.

70. A belt as claimed in claim 68 further comprising an intermediate layer between two of said plurality of layers, said intermediate layer being a film of said first polymeric resin material.

71. A belt as claimed in claim 68 wherein one of said plurality of layers is an on-machine-seamable fabric.

72. A belt as claimed in claim 39 wherein at least some of said fibers in said batt of staple fibers are coated with said first polymeric resin material.

73. A belt as claimed in claim 72 wherein said at least some of said fibers in said batt of staple fibers have a tie coat of a phenolic resin binding said first polymeric resin material thereto.

74. A belt as claimed in claim 39 wherein at least some of said fibers in said batt of staple fibers are of said first polymeric resin material.

75. A belt as claimed in claim 39 wherein said base support structure comprises a layer of yarns oriented in the longitudinal direction and a layer of yarns oriented in the transverse direction, said yarns in said two layers not being interwoven with one another.

76. A belt as claimed in claim 39 wherein said base support structure comprises a spiral-link fabric.

* * * * *